US010520168B2

(12) United States Patent
Chuang et al.

(10) Patent No.: US 10,520,168 B2
(45) Date of Patent: Dec. 31, 2019

(54) LAMPSHADE AND LAMP

(71) Applicants: LITE-ON ELECTRONICS (GUANGZHOU) LIMITED, Guangzhou (CN); Lite-On Technology Corporation, Taipei (TW)

(72) Inventors: Ching-Wen Chuang, Taipei (TW); Po-Chang Li, Taipei (TW); Ming-Hung Chien, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/913,923

(22) Filed: Mar. 7, 2018

(65) Prior Publication Data

US 2018/0306414 A1 Oct. 25, 2018

Related U.S. Application Data

(60) Provisional application No. 62/489,449, filed on Apr. 24, 2017.

(30) Foreign Application Priority Data

Jan. 5, 2018 (TW) ..... 107100416 A

(51) Int. Cl.

| | |
|---|---|
| ***F21V 17/00*** | (2006.01) |
| ***F21V 9/00*** | (2018.01) |
| ***F21V 17/12*** | (2006.01) |
| ***F21V 3/04*** | (2018.01) |
| ***F21V 3/06*** | (2018.01) |
| ***F21S 8/08*** | (2006.01) |
| ***F21V 31/00*** | (2006.01) |
| ***F21W 131/103*** | (2006.01) |
| ***F21Y 105/16*** | (2016.01) |
| ***F21Y 115/10*** | (2016.01) |

(52) U.S. Cl.

CPC ..... *F21V 17/002* (2013.01); *F21S 8/086* (2013.01); *F21V 3/049* (2013.01); *F21V 3/061* (2018.02); *F21V 9/00* (2013.01); *F21V 17/12* (2013.01); *F21V 31/00* (2013.01); *F21W 2131/103* (2013.01); *F21Y 2105/16* (2016.08); *F21Y 2115/10* (2016.08)

(58) Field of Classification Search

CPC ..... F21S 8/086; F21V 17/0002; F21V 17/12; F21V 31/00; F21V 3/049; F21V 3/061; F21V 9/00; F21V 5/004; F21V 17/002; F21W 2131/103; F21Y 2105/16; F21Y 2115/10

See application file for complete search history.

(56) References Cited

U.S. PATENT DOCUMENTS 7,188,972 B2 * 3/2007 Chen ..... F21V 5/04 362/237
8,201,970 B2 * 6/2012 Wang ..... F21V 17/12 362/249.01

(Continued)

*Primary Examiner* — Peggy A Neils
(74) *Attorney, Agent, or Firm* — JCIPRNET

(57) ABSTRACT

A lampshade including a frame and an optical function plate is provided. The frame includes an assembly portion. The optical function plate is detachably disposed to the frame through the assembly portion. Furthermore, a lamp including the above-mentioned lampshade is also provided.

20 Claims, 12 Drawing Sheets

(56) References Cited

U.S. PATENT DOCUMENTS

| | | | | |
|---|---|---|---|---|
| 8,220,960 | B2 * | 7/2012 | Long | F21V 21/116 362/249.02 |
| 8,454,196 | B2 * | 6/2013 | Ogura | F21S 8/086 362/249.01 |
| 8,506,127 | B2 * | 8/2013 | Russello | F21V 3/00 362/235 |
| 2002/0018344 | A1 * | 2/2002 | Sears, Jr. | H01R 29/00 362/265 |
| 2011/0317436 | A1 * | 12/2011 | Kuan | F21S 8/086 362/373 |
| 2013/0135876 | A1 * | 5/2013 | Phillips, III | F21V 5/04 362/335 |
| 2013/0215621 | A1 * | 8/2013 | Burmeister | F21V 3/04 362/293 |
| 2018/0238505 | A1 * | 8/2018 | Cartmill | F21V 5/04 |
| 2019/0032885 | A1 * | 1/2019 | Schmidt | F21V 5/02 |

* cited by examiner

LAMPSHADE AND LAMP

CROSS-REFERENCE TO RELATED APPLICATION

This application claims the priority benefit of U.S. provisional application Ser. No. 62/489,449, filed on Apr. 24, 2017 and Taiwan application serial no. 107100416, filed on Jan. 5, 2018. The entirety of each of the above-mentioned patent application is hereby incorporated by reference herein and made a part of this specification.

BACKGROUND

Technical Field

The disclosure relates to a lampshade and a lamp applying the lampshade.

Related Art

Lamps used in the field of road lighting are mostly overhead lamps. When a lampshade of a street light is damaged or needs to be replaced, the replacement thereof has to be carried out high in the air. However, in the street light, the lampshade is generally connected to a main body of the lamp by sleeving onto the main body, which makes it relatively difficult to replace the lampshade high in the air.

In addition, according to different lighting requirements, different optical designs are correspondingly required for the lampshade. If it is need to manufacture lampshades having different optical designs, it would be necessary to use different molds correspondingly. This leads to excessively high development costs.

SUMMARY

The disclosure provides a lampshade by applying which a lamp allows easier replacement of the lampshade and has lower development costs.

The disclosure provides a lamp including the above-mentioned lampshade, the lamp allowing easier replacement of the lampshade and having lower development costs.

One embodiment of the disclosure proposes a lampshade including a frame and an optical function plate. The frame includes an assembly portion. The optical function plate is detachably disposed to the frame through the assembly portion.

One embodiment of the disclosure proposes a lamp including a main body portion, a recessed portion, a light emitting unit and the above-mentioned lampshade. The recessed portion is connected to the main body portion and has an accommodating space. The light emitting unit is disposed in the accommodating space. The light emitting unit is adapted to emit at least one light beam. The lampshade is disposed in the recessed portion. The optical function plate is disposed on a transmission path of the light beam.

In one embodiment of the disclosure, the recessed portion includes an opening.

In one embodiment of the disclosure, an outer edge of the frame is complementary in shape to the opening.

In one embodiment of the disclosure, the frame is smaller than the opening, and a projection region of the frame onto the recessed portion is substantially identical to a projection region of the light emitting unit onto the recessed portion.

In one embodiment of the disclosure, the assembly portion includes at least one assembly slot. The optical function plate is slidably connected to the frame through the at least one assembly slot.

In one embodiment of the disclosure, the assembly portion includes an assembly opening. An outer edge of the optical function plate is complementary to an inner edge of the assembly opening.

In one embodiment of the disclosure, the frame further includes a plurality of positioning portions. The lampshade is adapted to be disposed on a lamp through these positioning portions.

In one embodiment of the disclosure, the lamp further includes a plurality of locking members. The recessed portion further includes a plurality of assembly holes, wherein each of the positioning portions is aligned with one of the assembly holes, and the locking members are respectively screwed into the positioning portions and the assembly holes to lock the frame to the recessed portion.

In one embodiment of the disclosure, the optical function plate includes a plurality of optical microstructures.

In one embodiment of the disclosure, the optical function plate further includes a filter material.

In one embodiment of the disclosure, the optical function plate includes a light transmissive cover.

In one embodiment of the disclosure, the lamp further includes a plurality of locking members. The frame further has a plurality of first positioning through holes. The light emitting unit further has a plurality of second positioning through holes. The locking members are respectively screwed into the first positioning through holes and the second positioning through holes to lock the frame to the light emitting unit.

In one embodiment of the disclosure, the lamp further includes a mesa portion. An outer edge of the mesa portion is complementary to the outer edge of the frame, and the frame is disposed on the mesa portion.

In one embodiment of the disclosure, the lamp further includes a plurality of locking members. The frame further has a plurality of first positioning through holes. The mesa portion further has a plurality of third positioning through holes. Each of the first positioning through holes is aligned with one of the third positioning through holes, wherein the locking members are respectively screwed into the first positioning through holes and the third positioning through holes to lock the frame to the mesa portion.

In one embodiment of the disclosure, the lamp further includes a waterproof frame. The waterproof frame is disposed between the frame and the light emitting unit, and the frame is disposed on the waterproof frame.

In one embodiment of the disclosure, the lamp further includes a plurality of locking members. The frame further has a plurality of first positioning through holes. The waterproof frame further has a plurality of fourth positioning through holes. Each of the first positioning through hole is aligned with one of the fourth positioning through holes, wherein the locking members are respectively screwed into the first positioning through holes and the fourth positioning through holes to lock the frame and the waterproof frame to the recessed portion.

Based on the above, in the lampshade according to an embodiment of the disclosure, the optical function plate is detachably disposed on the frame through the assembly portion of the frame, and the optical function plate can therefore be replaced more easily and quickly. Furthermore, the lampshade is capable of fulfilling different lighting requirements by replacement of optical function plates having different optical functions, so that development costs can be reduced. Since the lamp according to an embodiment of the disclosure has the above-mentioned lampshade, the lamp may enjoy the above-mentioned advantages.

To make the above features and advantages of the disclosure more comprehensible, several embodiments accompanied with drawings are described in detail as follows.

DETAILED DESCRIPTION OF DISCLOSED EMBODIMENTS

Figure 1:
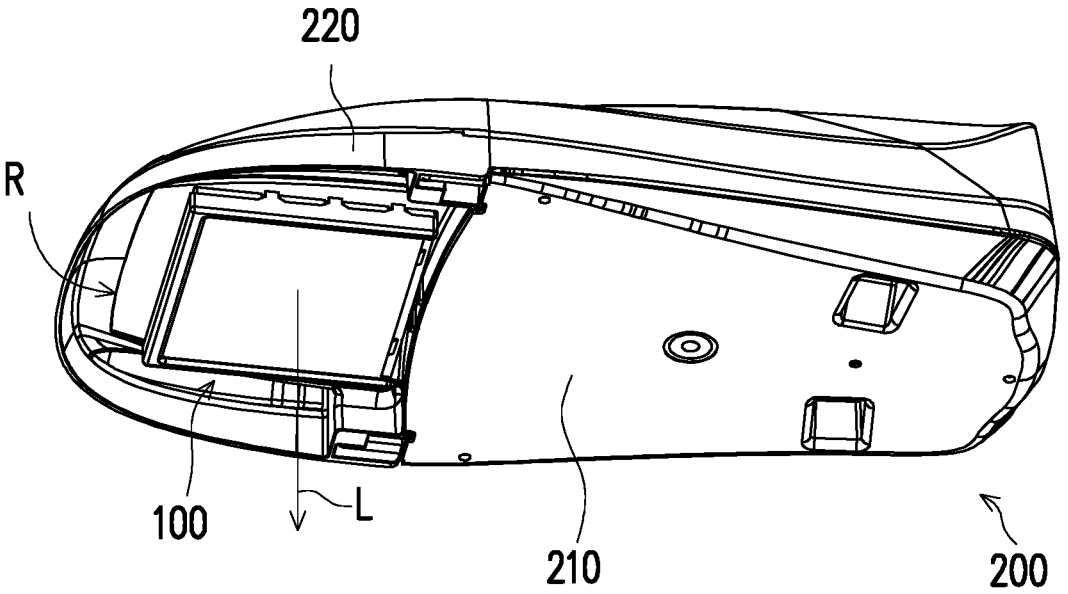
FIG. 1 is a schematic view of a lamp according to one embodiment of the disclosure.
Figure 2:
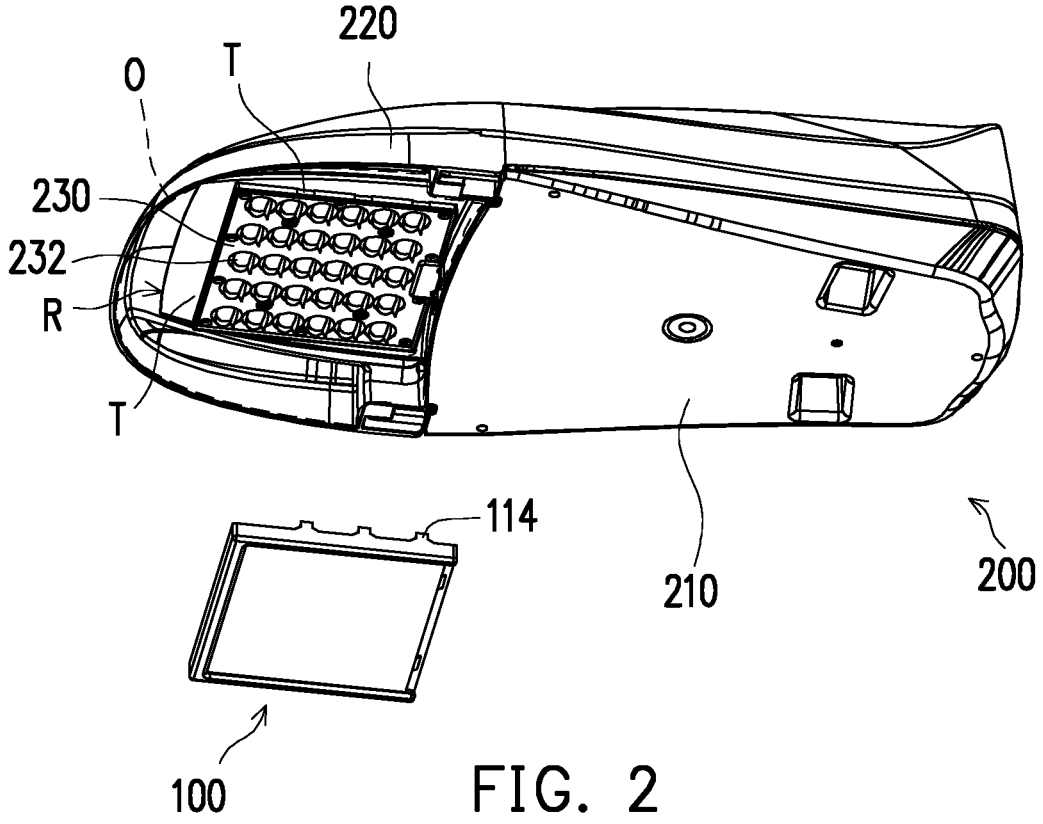
FIG. 2 is a schematic view of assembly of the lamp in FIG. 1.
Figure 3A:
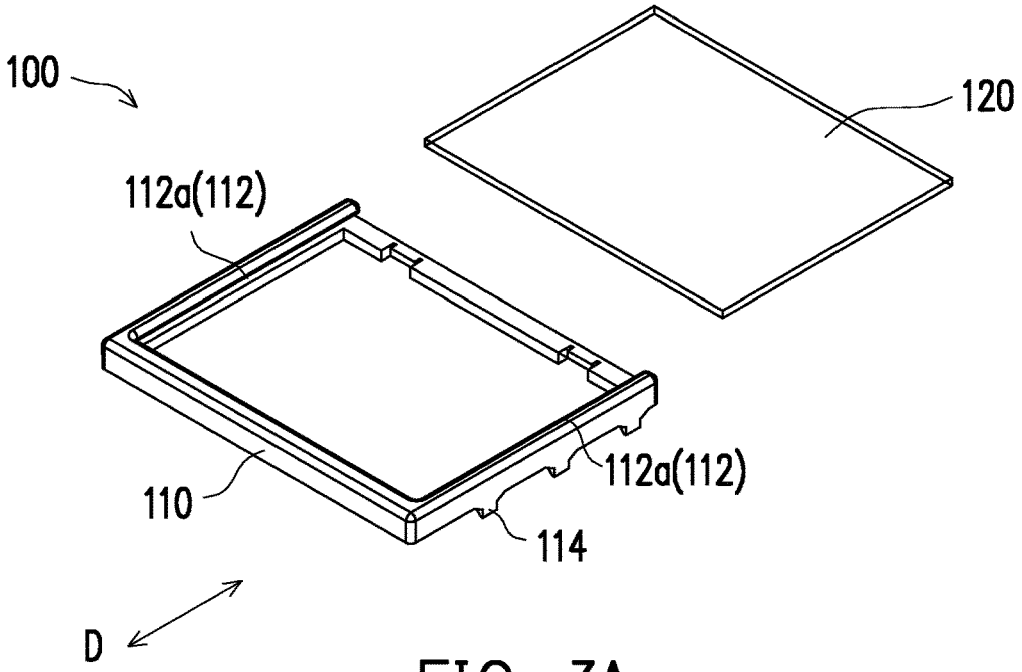
FIG. 3A to FIG. 3C are schematic views of assembly of a lampshade.
Figure 3B:
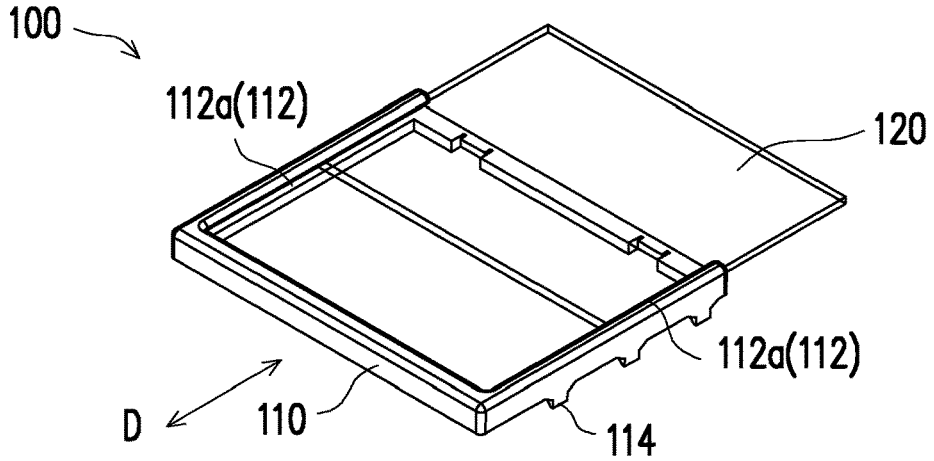
Figure 3C:
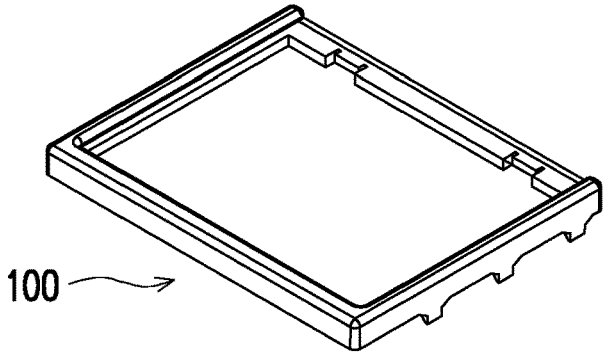
Figure 4:
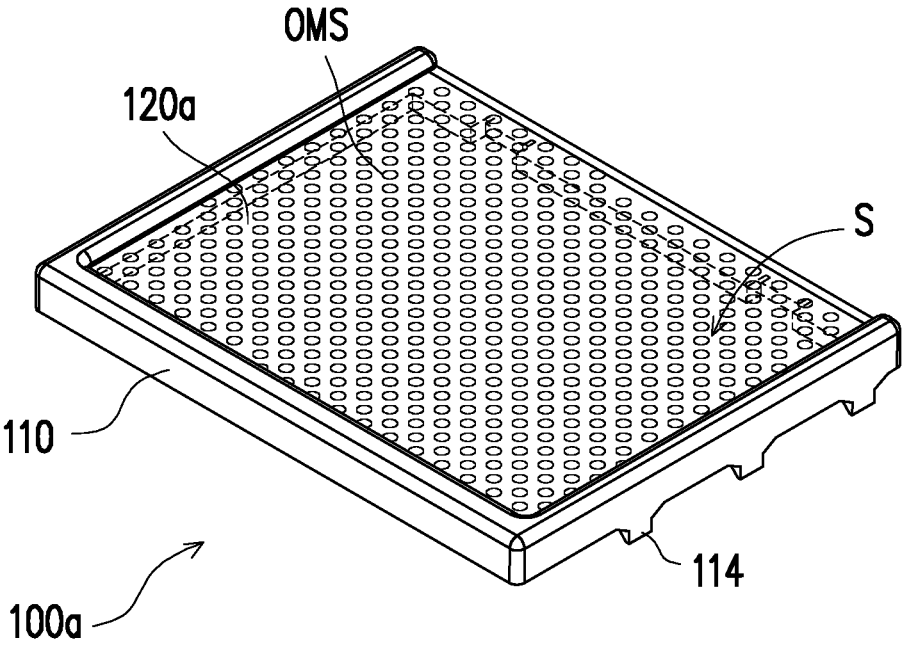
FIG. 4 and FIG. 5 are respectively schematic views of lampshades of different embodiments of the disclosure.
Figure 5:
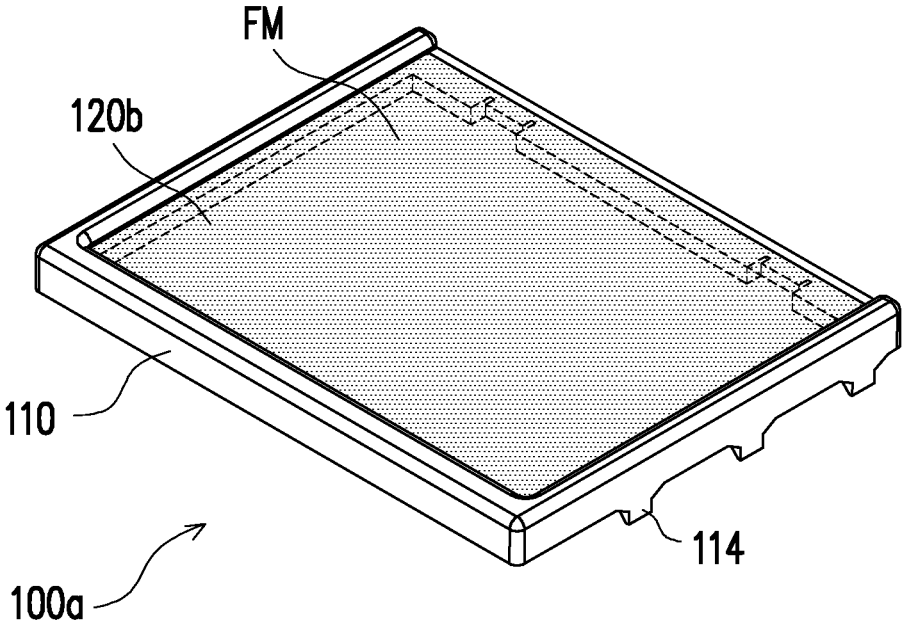

FIG. 1 is a schematic view of a lamp according to one embodiment of the disclosure. FIG. 2 is a schematic view of assembly of the lamp in FIG. 1. FIG. 3A to FIG. 3C are schematic views of assembly of a lampshade. FIG. 4 and FIG. 5 are respectively schematic views of lampshades of different embodiments of the disclosure.

Referring to FIG. 1 and FIG. 2, in the present embodiment, a lamp 200 is, for example, a street light. The lamp 200 includes a main body portion 210, a recessed portion 220, a light emitting unit 230 and a lampshade 100. The above-mentioned elements will be described in detail in the following paragraphs.

The main body portion 210 is connected to a pole (not shown) of the lamp 200 so as to be erected on a road. A controller (not shown) is disposed in the main body portion 210 to control the light emitting unit 230 to emit or not.

The recessed portion 220 is connected to the main body portion 210, and the recessed portion 220 is, for example, formed integrally with the main body portion 210. The recessed portion 220 has an accommodating space R. The light emitting unit 230 is disposed in the accommodating space R and is electrically connected to the recessed portion 220. The recessed portion 220 includes an opening O communicating with the containing space R.

The light emitting unit 230 includes a plurality of light emitting elements (not shown) and a plurality of lenses 232 (as shown in FIG. 2). The light emitting elements are controlled by the controller to be adapted to emit a light beam L, and the light emitting elements are implemented as, for example but not limited to, light emitting diodes. The lens 232 is correspondingly disposed on an optical path of one of the light emitting elements. The lenses 232 are configured to modify a light pattern of the light beam L. In the present embodiment, an outer edge of the light emitting unit 230 has a plurality of engagement slots T.

Referring to FIG. 3A to FIG. 3C, the lampshade 100 includes a frame 110 and an optical function plate 120. The frame 110 includes an assembly portion 112 and a plurality of positioning portions 114. The optical function plate 120 is detachably disposed on the frame 110 through the assembly portion 112. Specifically, in the present embodiment, the assembly portion 112 includes at least one assembly slot 112*a*, the at least one assembly slot 112*a* being, for example, two symmetrical assembly slots 112*a*. The optical function plate 120 may be slidably connected to the frame 110 in a direction D through these two assembly slots 112*a*, and is positioned by being stopped by the frame 110. In other words, the optical function plate 120 may be detachably disposed on the frame 110 in an extractable manner through the assembly slots 112*a*.

In another aspect, referring again to FIG. 2, the positioning portions 114 are implemented as, for example, fasteners. By engagement of the positioning portions 114 with the engagement slots T of the light emitting unit 230, the frame 110 is disposed in the recessed portion 220. The frame 110 is smaller than the opening O of the recessed portion 220. A projection region of the frame 110 onto the recessed portion 220 is substantially identical to a projection region of the light emitting unit 230 onto the recessed portion 220. The optical function plate 120 is disposed on a transmission path of the light beam L. The light beam L passes through the optical function plate 120 to be transmitted outside. In the present embodiment, the optical function plate 120 includes a light transmissive cover having functions of light transmission, dust protection and waterproofing. A material of the light transmissive cover is, for example but not limited to, glass.

It should be noted that part of the content of the aforesaid embodiment also applies to the following embodiments, and description of the same technical content will be omitted. Elements having the same reference numerals can be understood with reference to part of the content of the aforesaid embodiment, and description of these elements will not be repeated.

Referring to FIG. 4, a lampshade 100*a* in FIG. 4 is similar to the lampshade 100 in FIG. 1 and FIG. 2, and a main difference therebetween lies in that an optical function plate 120*a* includes a plurality of optical microstructures OMS. The optical microstructures OMS are, for example, protruding structures formed on a surface S of the optical function plate 120*a*. The lampshade 100*a* in FIG. 4 may be engaged with the recessed portion 220 in the manner similar to that depicted in FIG. 2. The optical function plate 120*a* in FIG. 4 may be assembled onto the frame 110 in the manner similar to that depicted in FIG. 3A to FIG. 3C. In the lampshade 100*a* of the present embodiment, by designing the optical function plate 120*a* to include the optical microstructures OMS, the light beam L emitted by the light emitting unit 230 can further be uniformly diffused. In one embodiment, the optical microstructures OMS may be recessed structures to correspondingly cause the light beam L to have a different light pattern design. The disclosure is not limited thereto. In another embodiment, the optical microstructures OMS may also be disposed inside the optical function plate 120*a*, and the disclosure is not limited thereto.

Referring to FIG. 5, a lampshade 100*b* in FIG. 5 is similar to the lampshade 100 in FIG. 1 and FIG. 2, and a main difference therebetween lies in that an optical function plate 120*b* further includes a filter material FM. The filter material FM is, for example, a substance capable of filtering light beams in a specific wavelength range and allowing light beams in other wavelength ranges to pass therethrough. In the present embodiment, the filter material FM is, for example, capable of filtering blue light in the light beam L. Thus, when the light beam L passes through the optical function plate 120*b*, the blue light in the light beam L is filtered, while yellow-green light or red light passes through the optical function plate 120*b* to meet a lighting requirement of filtering blue light (or low color temperature light). The disclosure does not limit what color light is filtered by the filter material FM. Similarly, the lampshade 100*b* in FIG. 5 may be engaged with the recessed portion 220 in the manner similar to that depicted in FIG. 2. The optical function plate 120*b* in FIG. 5 may be assembled onto the frame 110 in the manner similar to that depicted in FIG. 3A to FIG. 3C. In the lampshade 100*b* of the present embodiment, since the optical function plate 120*b* includes the filter material FM, the color temperature of the light beam L may be changed.

It is known from the above-mentioned several embodiments that, in the lampshade according to an embodiment of the disclosure, by replacing the optical function plate 120 having different optical functions, the light beam L may achieve different optical effects. The optical functions of the optical function plates 120, 120*a* and 120*b* are only described for exemplary purposes, and other optical functions may also be provided. The disclosure is not limited thereto.

Figure 6:
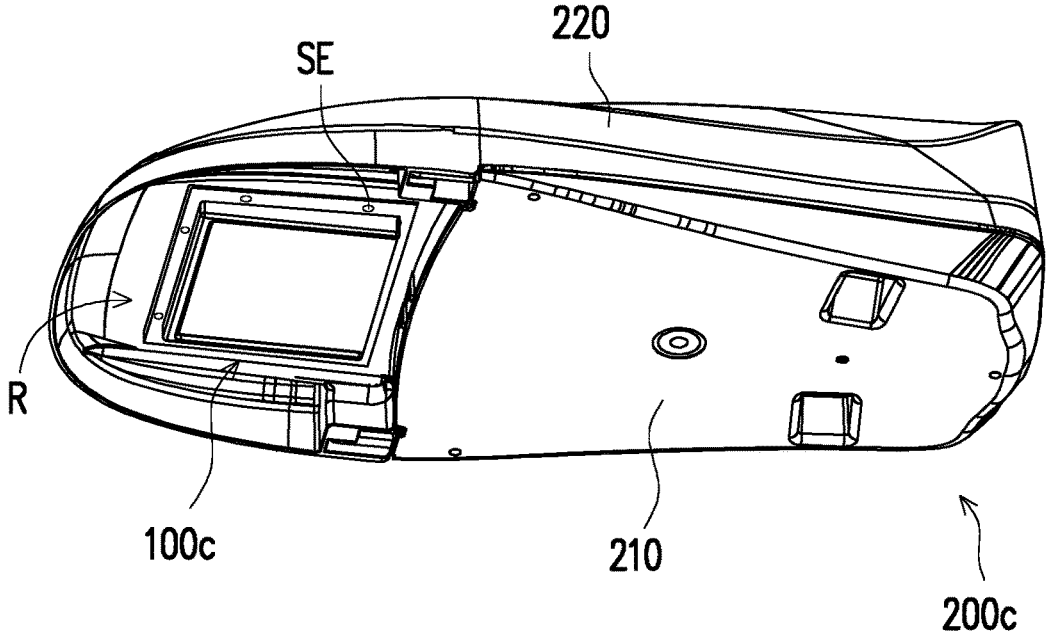
FIG. 6 is a schematic view of a lamp according to another embodiment of the disclosure.
Figure 7:
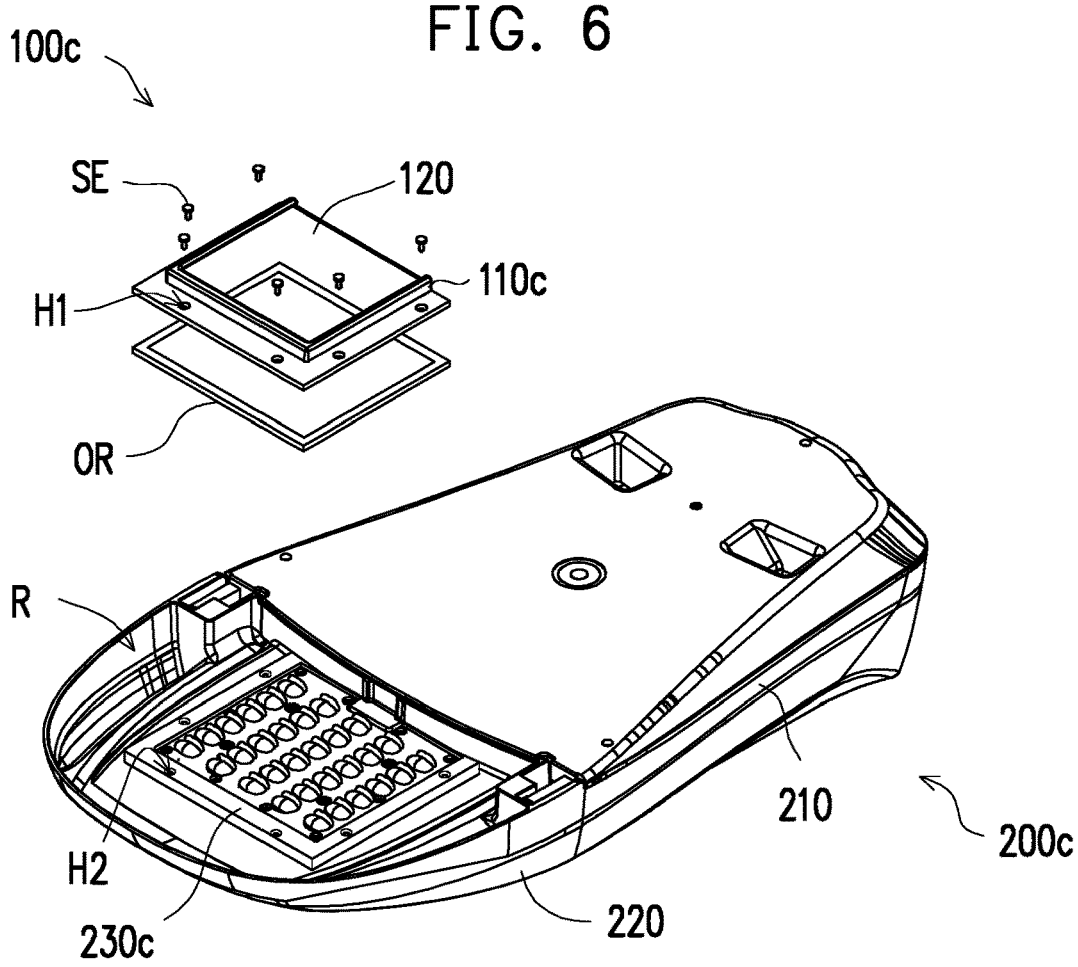
FIG. 7 is a schematic view of assembly of the lamp in FIG. 6.

FIG. 6 is a schematic view of a lamp according to another embodiment of the disclosure. FIG. 7 is a schematic view of assembly of the lamp in FIG. 6.

Referring to FIG. 6 and FIG. 7, a lamp 200*c* in FIG. 6 and FIG. 7 is roughly identical to the lamp 200 in FIG. 1, and a main difference therebetween lies in that a lampshade 100*c* is disposed in the recessed portion 220 in a different manner. Specifically, the lamp 200*c* further includes a plurality of locking members SE and an O ring OR. The locking members SE are implemented as, for example but not limited to, screws. In other embodiments, the locking members SE are, for example, elements having similar functions, such as bolts, or hooks, or a combination thereof. The O ring OR is disposed between a frame 110*c* and a light emitting unit 230*c*. The frame 110*c* further has a plurality of first positioning through holes H1. The light emitting unit 230*c* has a plurality of second positioning through holes H2. Each of the first positioning through holes H1 is aligned with one of the second positioning through holes H2. That is to say, the first positioning through holes H1 are respectively aligned with the second positioning through holes. The locking members SE are respectively screwed into the first positioning through holes H1 and the second positioning through holes H2 to lock the frame 110*c* to the light emitting unit 230*c*.

Figure 8:
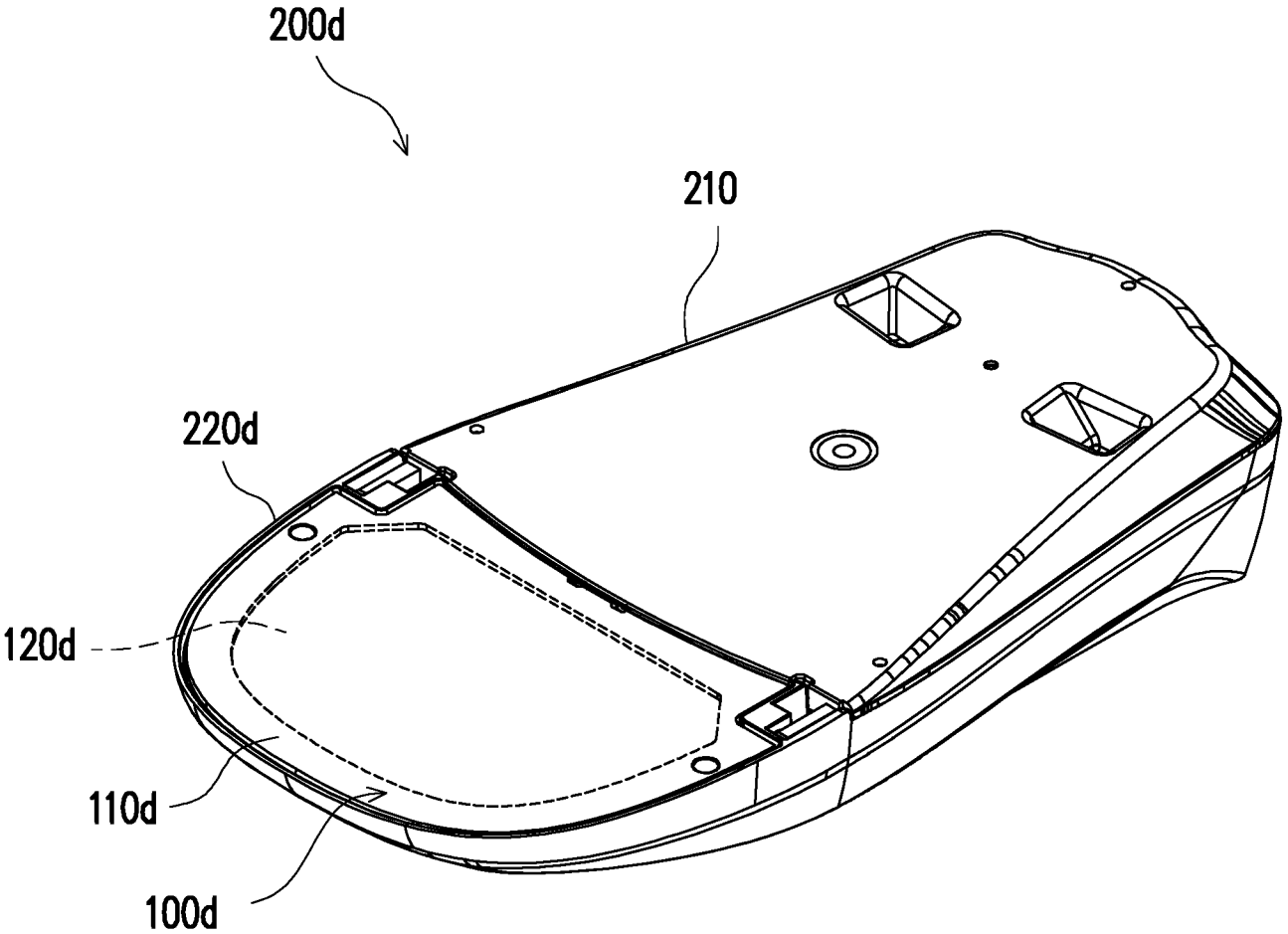
FIG. 8 is a schematic view of a lamp according to still another embodiment of the disclosure.
Figure 9:
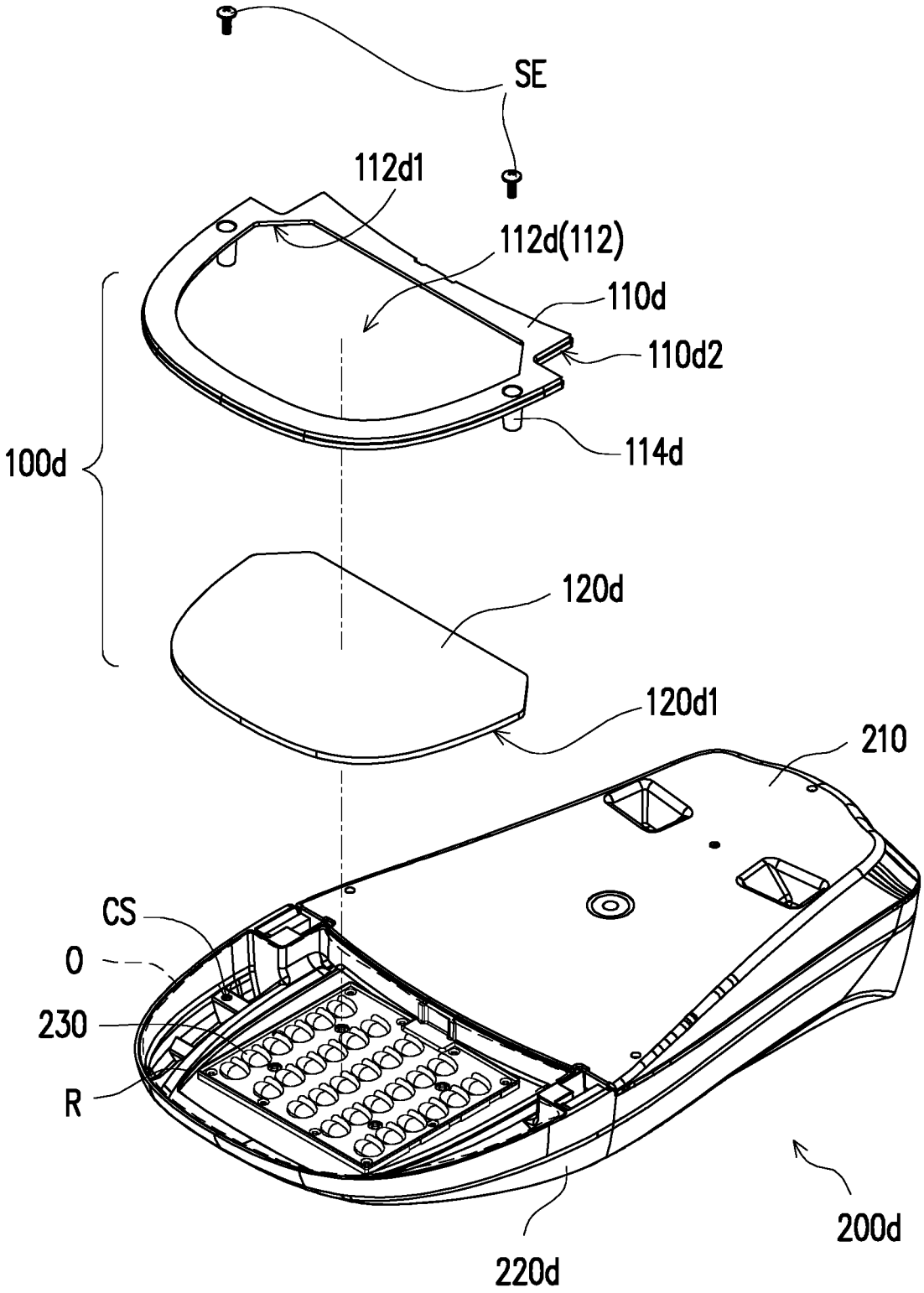
FIG. 9 is a schematic view of assembly of the lamp in FIG. 8.

FIG. 8 is a schematic view of a lamp according to still another embodiment of the disclosure. FIG. 9 is a schematic view of assembly of the lamp in FIG. 8.

Referring to FIG. 8 and FIG. 9, a lamp 200*d* in FIG. 8 and FIG. 9 is roughly identical to the lamp 200 in FIG. 1, and a main difference therebetween lies in that the assembly portion 112 of a frame 110*d* includes an assembly opening 112*d*. An inner edge 112*d*1 of the assembly opening 112*d* is complementary to an outer edge 120*d*1 of an optical function plate 120*d*. Accordingly, the optical function plate 120*d* can be detachably disposed on the frame 110*d* by the above-mentioned design of complementary shapes and by being fitted into the assembly opening 112*d*. In addition, an outer edge 110*d*2 of the frame 110*d* is complementary in shape to the opening O. A projection region of the frame 110*d* onto a recessed portion 220*d* is larger than a projection region of the light emitting unit 230 onto the recessed portion 220*d*. The lamp 200*d* further includes a plurality of locking members SE. The frame 110*d* further includes a plurality of positioning portions 114*d*. Each of the positioning portions 114*d* is aligned with one of the assembly holes CS of the recessed portion 220*d*. The locking members SE are respectively screwed into the positioning portions 114*d* and the assembly holes CS to dispose the frame 110*d* into the recessed portion 220*d*.

Figure 10:
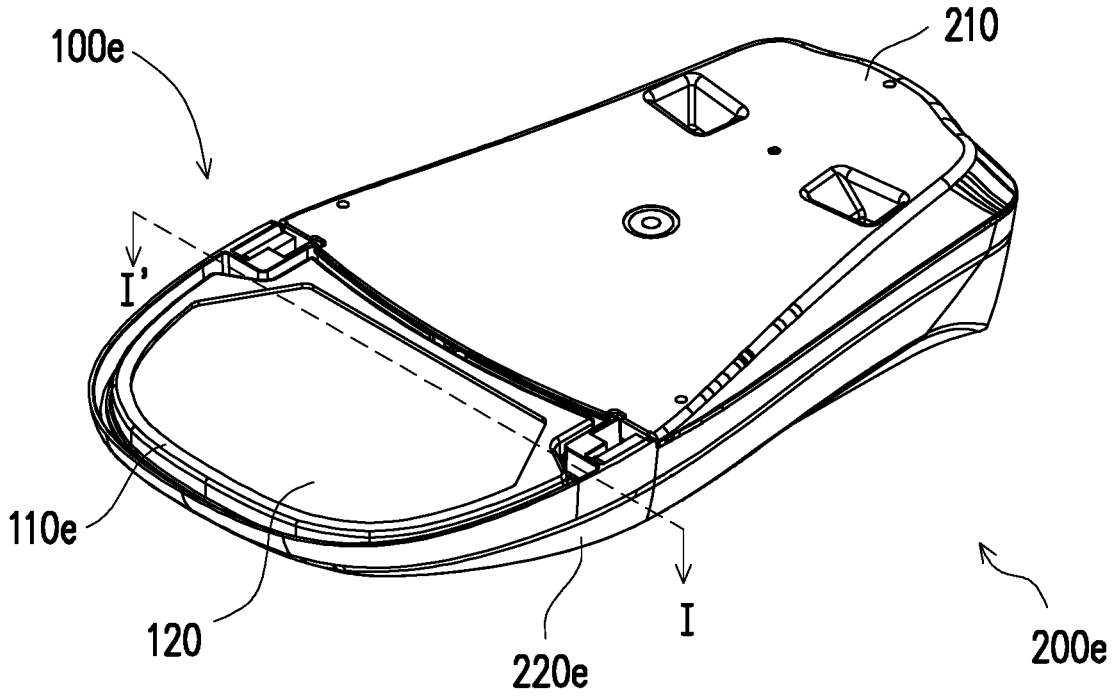
FIG. 10 is a schematic view of a lamp according to another embodiment of the disclosure.
Figure 11:
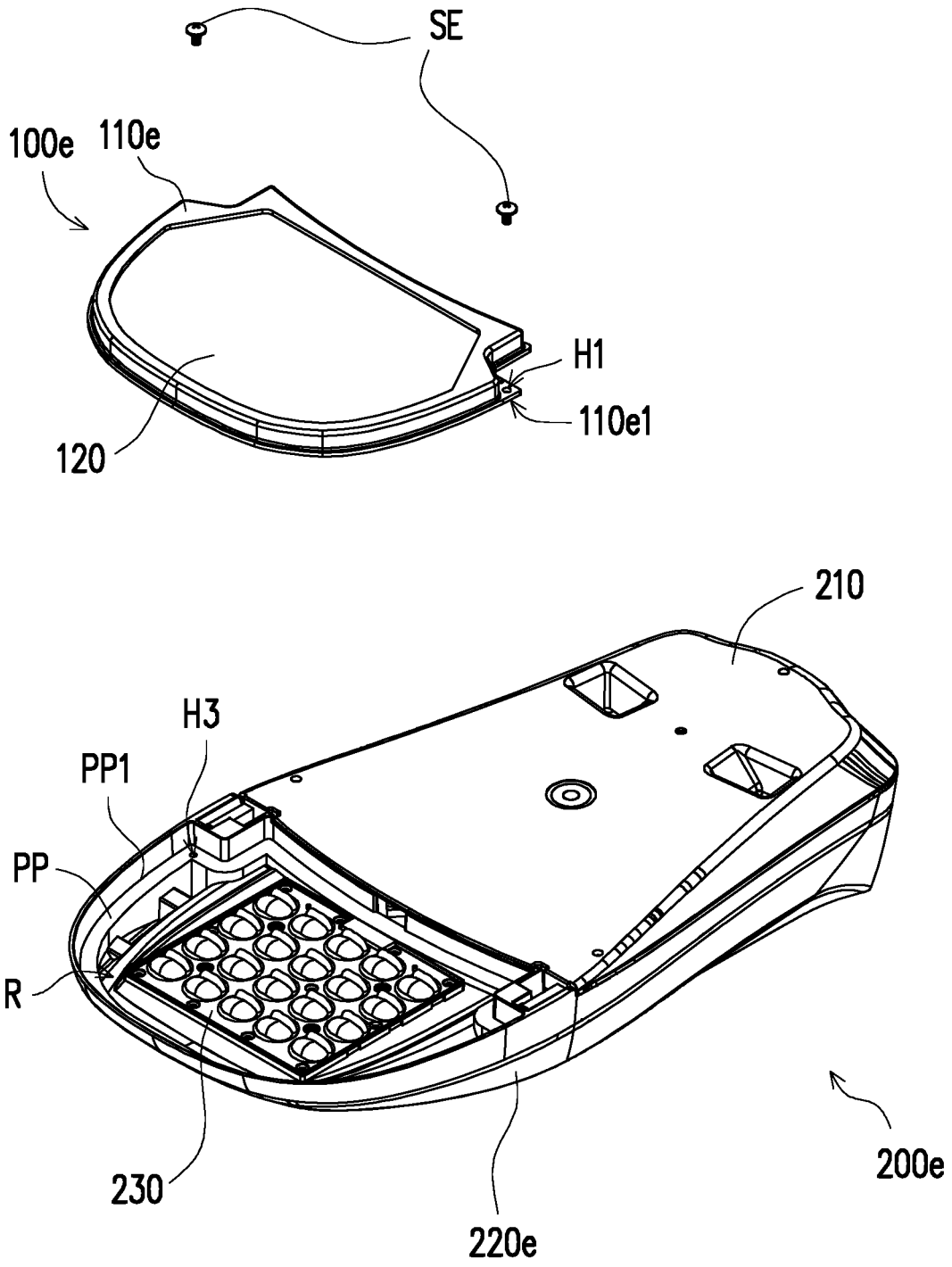
FIG. 11 is a schematic view of assembly of the lamp in FIG. 10.
Figure 12:
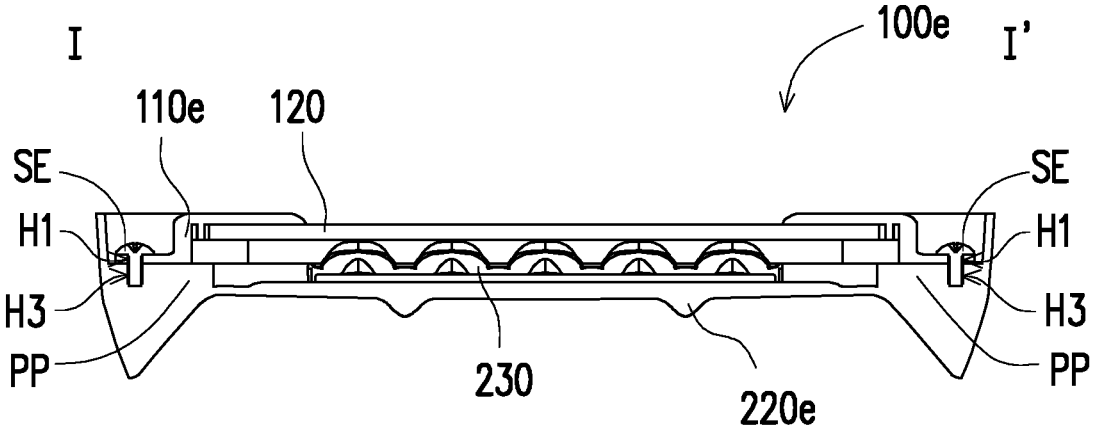
FIG. 12 is a schematic cross-sectional view taken along sectional line I-I' in FIG. 10.

FIG. 10 is a schematic view of a lamp according to still another embodiment of the disclosure. FIG. 11 is a schematic view of assembly of the lamp in FIG. 10. FIG. 12 is a schematic cross-sectional view taken along sectional line I-I' in FIG. 10.

Referring to FIG. 10 to FIG. 12, a lamp 200*e* in FIG. 10 to FIG. 12 is roughly identical to the lamp 200*d* in FIG. 8 and FIG. 9, and a main difference therebetween lies in that, in the present embodiment, a mesa portion PP is further disposed in a recessed portion 220*e*. An outer edge PP1 of the mesa portion PP is complementary to an outer edge 110*e*1 of a frame 110*e*. The frame 110*e* is disposed on the mesa portion PP. Specifically, the lamp 200*e* further includes a plurality of locking members SE. The frame 110*e* has a plurality of first positioning through holes H1. The mesa portion PP has a plurality of third positioning through holes H3. Each of the first positioning through holes H1 is aligned with one of the third positioning through holes H3. That's to say, the first positioning through holes H1 are respectively aligned with the third positioning through holes H3. The locking members SE are respectively screwed into the first positioning through holes H1 and the third positioning through holes H3 to lock the frame 110*e* to the mesa portion PP. In addition, in the lamp 200*e* of the present embodiment, the frame 110*e* and the mesa portion PP may further be glued together by a gel.

Following the above, in the lamp 200*e* of the present embodiment, since the frame 110*e* is locked to the mesa portion PP by the locking members SE, the frame 110*e* can be more tightly disposed in the recessed portion 220*e*. Thus, liquid or dust is relatively unlikely to enter space between a lampshade 100*e* and the recessed portion 220*e* to affect electrical characteristics of the light emitting unit 230. By the above-mentioned configuration, waterproofing and dust protection effects of the lamp 200*e* of the present embodiment, for example, may achieve a rating of IP66.

Figure 13:
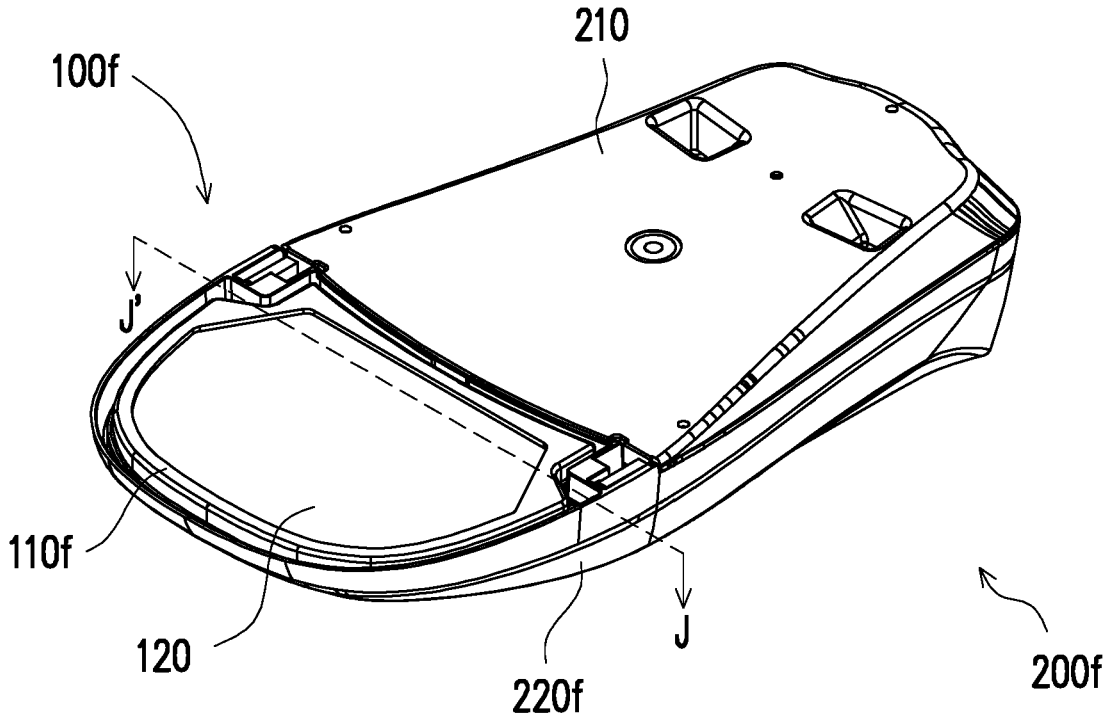
FIG. 13 is a schematic view of a lamp according to still another embodiment of the disclosure.
Figure 14:
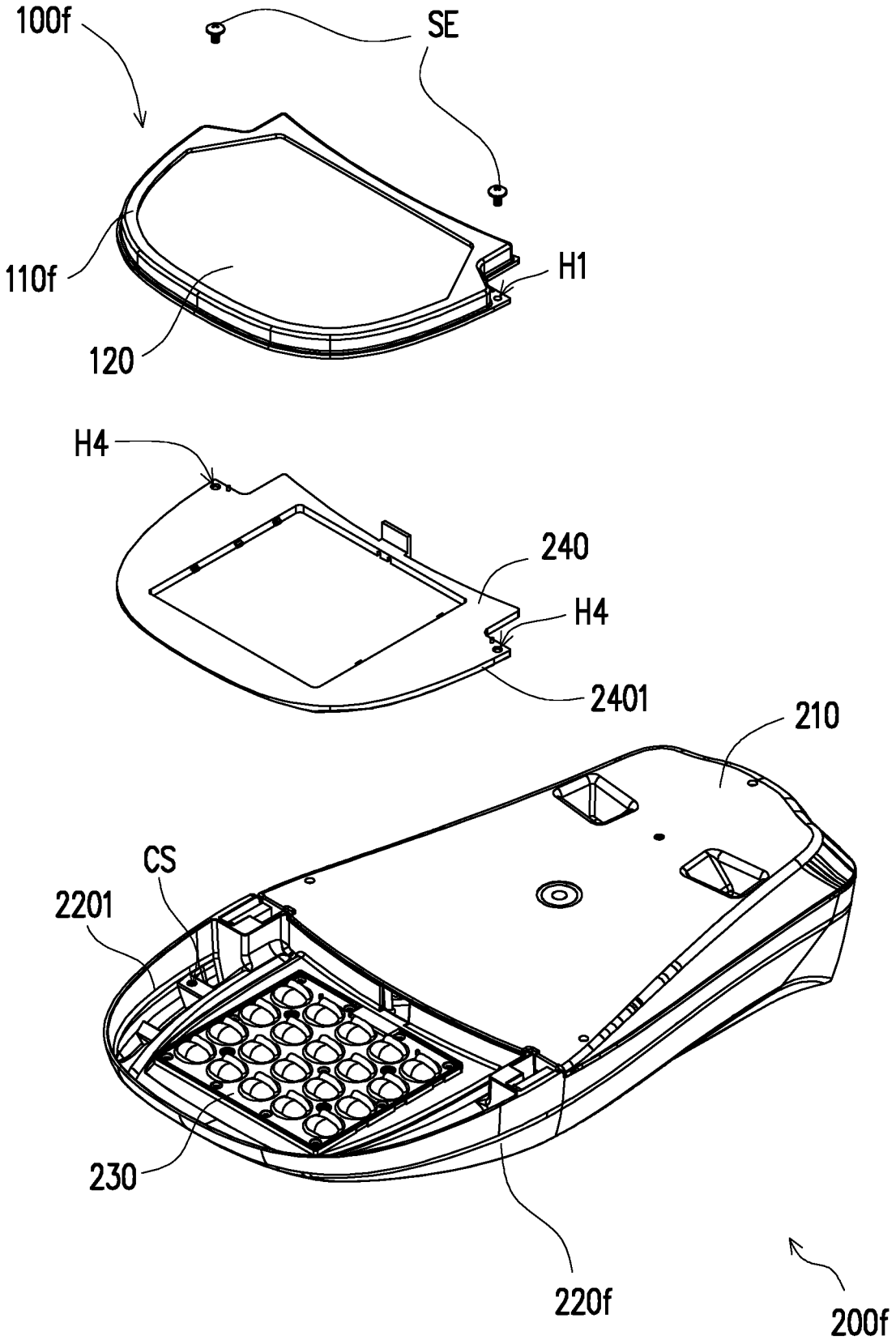
FIG. 14 is a schematic view of assembly of the lamp in FIG. 13.
Figure 15:
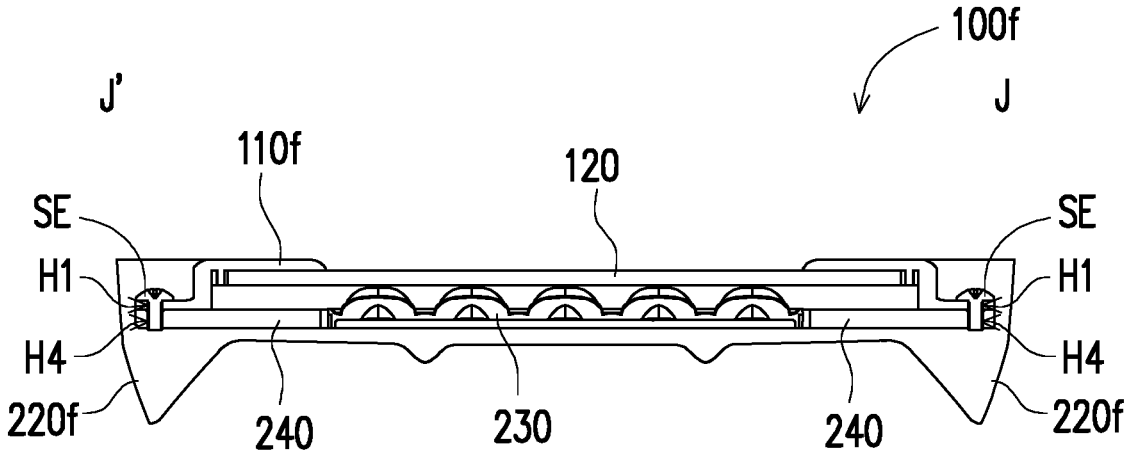
FIG. 15 is a schematic cross-sectional view taken along sectional line J-J' in FIG. 13.

FIG. 13 is a schematic view of a lamp according to still another embodiment of the disclosure. FIG. 14 is a schematic view of assembly of the lamp in FIG. 13. FIG. 15 is a schematic cross-sectional view taken along sectional line J-J' in FIG. 13.

Referring to FIG. 13 to FIG. 15, a lamp 200*f* in FIG. 13 to FIG. 15 is roughly identical to the lamp 200*d* in FIG. 8 and FIG. 9, and a main difference therebetween lies in that, in the present embodiment, a lamp 200*f* further includes a waterproof frame 240. The waterproof frame 240 is disposed between a frame 110*f* and the light emitting unit 230. An outer edge 2401 of the waterproof frame 240 is complementary to an inner wall 2201 of a recessed portion 220*f*. In addition, the lamp 200*f* further includes a plurality of locking members SE. The frame 120 has a plurality of first positioning through holes H1. The waterproof frame 240 has a plurality of fourth positioning through holes H4. Each of the first positioning through holes H1 is aligned with one of the fourth positioning through holes H4. That's to say, the first positioning through holes H1 are respectively aligned with the fourth positioning through holes H4. The locking members SE are respectively screwed into the first positioning through holes H1 and the fourth positioning through holes H4 to lock the frame 110*f* and the waterproof frame 240 into the assembly holes CS of the recessed portion 220*f* In addition, in the lamp 200*f* of the present embodiment, the waterproof frame 240 and the recessed portion 220*f* may further be glued together by a gel.

Following the above, in the lamp 200*e* of the present embodiment, the frame 110*f* and the waterproof frame 240 are locked to the recessed portion 220*f* by the locking members SE. By the above-mentioned configuration, the frame 110*f* and the waterproof frame 240 can be more tightly disposed in the recessed portion 220*f*, and moreover, the dust protection and waterproofing functions of the waterproof frame 240 can further be improved. Thus, liquid or dust is more unlikely to enter space between a lampshade 100*f* and the recessed portion 220*f* to affect electrical characteristics of the light emitting unit 230. By the above-mentioned configuration, waterproofing and dust protection effects of the lamp 200*f* of the present embodiment, for example, may also achieve a rating of IP66.

In summary, in the lampshade according to an embodiment of the disclosure, the optical function plate is detachably disposed on the frame through the assembly portion of the frame, and the optical function plate can therefore be replaced more easily and quickly. For example, the optical function plate may be detachably disposed on the frame in an extractable manner through the assembly slot; alternatively, by designing the outer edge of the optical function plate and the inner edge of the frame to have complementary shapes and by fitting the optical function plate to the frame, the optical function plate may be detachably disposed on the frame. Furthermore, according to the above-mentioned configuration, the lampshade according to an embodiment of the disclosure may fulfill different lighting requirements by replacement of the optical function plates having the same shape and different optical functions. Compared to the related art in which lampshades having different optical functions are manufactured using different molds, the process of manufacturing the optical function plates having different optical functions is relatively easy and rarely requires a mold. Therefore, the number of development molds can be reduced and development costs can be reduced. In another respect, the optical function plates respectively having different optical functions may have fixed sizes and specifications to accelerate product development. Since the lamp according to an embodiment of the disclosure has the above-mentioned lampshade, the lamp may enjoy the above-mentioned advantages.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A lamp, comprising:

a main body portion;

a recessed portion, connected to the main body portion, the recessed portion having an accommodating space;

a light emitting unit, disposed in the accommodating space, the light emitting unit being adapted to emit at least one light beam;

a lampshade, disposed in the recessed portion, the lampshade comprising:

a frame, comprising an assembly portion, and the frame further comprises a plurality of positioning portions, and the lampshade is disposed in the recessed portion of the lamp through the positioning portions; and an optical function plate, detachably disposed to the frame through the assembly portion, and the optical function plate being disposed on a transmission path of the light beam, wherein the assembly portion comprises at least one assembly slot, and the optical function plate is slidably connected to the frame through the at least one assembly slot; and a plurality of locking members, the recessed portion further comprises a plurality of assembly holes, each of the positioning portions is aligned with one of the assembly holes, and the locking members are respectively screwed into the positioning portions and the assembly holes to lock the frame to the recessed portion.

2. The lamp of claim 1, wherein the recessed portion comprises an opening.

3. The lamp of claim 2, wherein an outer edge of the frame is complementary in shape to the opening.

4. The lamp of claim 2, wherein the frame is smaller than the opening, and a projection region of the frame onto the recessed portion is substantially identical to a projection region of the light emitting unit onto the recessed portion.

5. The lamp of claim 1, wherein the assembly portion comprises an assembly opening, and an outer edge of the optical function plate is complementary to an inner edge of the assembly opening.

6. The lamp of claim 1, wherein the optical function plate comprises a plurality of optical microstructures.

7. The lamp of claim 1, wherein the optical function plate further comprises a filter material.

8. The lamp of claim 1, wherein the optical function plate comprises a light transmissive cover.

9. The lamp of claim 1, further comprising a plurality of locking members, wherein the frame further has a plurality of first positioning through holes, the light emitting unit further has a plurality of second positioning through holes, each of the first positioning through holes is aligned with one of the second positioning through hole, and the locking members are respectively screwed into the first positioning through holes and the second positioning through holes to lock the frame to the light emitting unit.

10. The lamp of claim 1, wherein the recessed portion further comprises a mesa portion, an outer edge of the mesa portion is complementary to an outer edge of the frame, and the frame is disposed on the mesa portion.

11. The lamp of claim 1, further comprising a waterproof frame, wherein the waterproof frame is disposed between the frame and the light emitting unit, and the frame is disposed on the waterproof frame.

12. The lamp of claim 11, further comprising a plurality of locking members, wherein the frame further has a plurality of first positioning through holes, the waterproof frame further has a plurality of fourth positioning through holes, each of the first positioning through holes is aligned with one of the fourth positioning through holes, and the locking members are respectively screwed into the first positioning through holes and the fourth positioning through holes to lock the frame and the waterproof frame to the recessed portion.

13. A lamp, comprising:

a main body portion;

a recessed portion, connected to the main body portion, the recessed portion having an accommodating space, wherein the recessed portion further comprises a mesa portion, an outer edge of the mesa portion is complementary to an outer edge of the frame, and the frame is disposed on the mesa portion;

a light emitting unit, disposed in the accommodating space, the light emitting unit being adapted to emit at least one light beam;

a lampshade, disposed in the recessed portion, the lampshade comprising:

a frame, comprising an assembly portion;

an optical function plate, detachably disposed to the frame through the assembly portion, and the optical function plate being disposed on a transmission path of the light beam, wherein the assembly portion comprises at least one assembly slot, and the optical function plate is slidably connected to the frame through the at least one assembly slot; and a plurality of locking members, wherein the frame further has a plurality of first positioning through holes, the mesa portion further has a plurality of third positioning through holes, each of the first positioning through hole is aligned with one of the third positioning through holes, and the locking members are respectively screwed into the first positioning through holes and the third positioning through holes to lock the frame to the mesa portion.

14. The lamp of claim 13, wherein the recessed portion comprises an opening.

15. The lamp of claim 14, wherein an outer edge of the frame is complementary in shape to the opening.

16. The lamp of claim 14, wherein the frame is smaller than the opening, and a projection region of the frame onto the recessed portion is substantially identical to a projection region of the light emitting unit onto the recessed portion.

17. The lamp of claim 13, wherein the assembly portion comprises an assembly opening, and an outer edge of the optical function plate is complementary to an inner edge of the assembly opening.

18. The lamp of claim 13, wherein the optical function plate comprises a plurality of optical microstructures.

19. The lamp of claim 13, wherein the optical function plate further comprises a filter material.

20. The lamp of claim 13, wherein the optical function plate comprises a light transmissive cover.

* * * * *